US005503125A

United States Patent [19]

Gund

[11] Patent Number: 5,503,125

[45] Date of Patent: Apr. 2, 1996

[54] AIR VANE GOVERNOR WITH IMPROVED DROOP CHARACTERISTICS

[75] Inventor: Heinz K. Gund, Brookfield, Wis.

[73] Assignee: Briggs & Stratton Corporation, Wauwatosa, Wis.

[21] Appl. No.: 494,700

[22] Filed: Jun. 26, 1995

[51] Int. Cl.[6] ..... F02D 31/00

[52] U.S. Cl. ..... 123/392

[58] Field of Search ..... 123/378, 392, 123/391

[56] References Cited

U.S. PATENT DOCUMENTS

| | | | |
|---|---|---|---|
| 2,529,243 | 11/1950 | Brown et al. | 123/392 |
| 2,803,757 | 8/1957 | McFarland | 290/40 F |
| 3,092,084 | 6/1963 | Thorner | 123/376 |
| 3,276,439 | 10/1966 | Reichenbach | 123/376 |
| 3,721,309 | 3/1973 | Donaldson | 180/171 |
| 4,300,506 | 11/1981 | Knapp et al. | 123/478 |
| 4,359,990 | 11/1982 | Kromer et al. | 123/453 |
| 4,455,978 | 6/1984 | Atago et al. | 123/339.19 |
| 4,517,942 | 5/1985 | Pirkey et al. | 123/376 |
| 4,773,371 | 9/1988 | Stenz | 123/376 |
| 4,836,167 | 6/1989 | Huffman et al. | 123/376 |
| 5,003,949 | 4/1991 | Fanner et al. | 123/382 |
| 5,131,360 | 7/1992 | Muschalik | 123/339.15 |
| 5,146,889 | 9/1992 | Swanson et al. | 123/376 |
| 5,195,490 | 3/1993 | Maier | 123/373 |

*Primary Examiner*—Andrew M. Dolinar
*Attorney, Agent, or Firm*—Michael, Best & Friedrich

[57] ABSTRACT

The air vane governor has improved speed droop characteristics under no load and light load conditions to prevent engine stumbling. The air vane governor includes a primary spring and a secondary spring; both springs oppose the movement of the air vane at no load and light load conditions. At increased load, the secondary spring drops out. The tension on both springs is adjustable. The added spring force of the secondary spring makes the governor less sensitive at no load and light load, resulting in more even operation, particularly during engine warmup.

22 Claims, 4 Drawing Sheets

AIR VANE GOVERNOR WITH IMPROVED DROOP CHARACTERISTICS

FIELD OF THE INVENTION

This invention relates to air vane governors for internal combustion engines. More particularly, this invention relates to apparatus that changes the droop characteristics of an air vane governor at low load and light load conditions.

Air vane governors are known for internal combustion engines. In a typical air vane governor, a rotatable flywheel or other support member supports a plurality of spaced fins that rotate with the flywheel. As the fins rotate, they generate an air flow that is deflected by a pivotable air vane. A link member connects the opposite end of the air vane to a throttle control lever, which is connected to the throttle. A governor spring opposes the movement of the air vane, such that the governed speed is determined by the interplay between the movement of the air vane on the one hand and the spring force and tension of the governor spring. The rotatable throttle lever opens or closes the throttle, thereby increasing or decreasing engine speed, to yield the governed speed.

The engine speed drops when a load is applied to the engine. This drop in engine speed is called "speed droop". The rate of speed droop is a characteristic of a particular engine, and is in part determined by spring rate and the tension applied to the governor spring.

The typical speed droop in a prior art air vane governor having a single governor spring is on the order of 600 to 800 revolutions per minute (rpm). Attempts have been made to reduce the speed droop of an air vane governor to about 300 to 500 rpm, simply by changing the spring rate or the tension on the governor spring. These approaches have been unsatisfactory because the governor has a tendency to react to small sensed changes in the engine load when the speed droop is 300 to 500 rpm. When no load or only a light load is applied to the engine, the governor has a tendency to misinterpret the small load or the changing conditions of the engine as the engine is warming up; as a result the governor has a tendency to seek the proper speed. To the operator of the engine, it appears that the engine is sputtering or stumbling during engine warmup.

For example, assume that an engine equipped with a typical air vane governor is used on a lawnmower. When the engine is warming up and the lawn mower is not cutting grass, there is no load or only a light load the—the rotating blade and flywheel—applied to the engine. When the engine is warming up, conditions of the engine are changing; for example, thermal expansion and lubrication factors cause the rotating components to react differently then when the engine is completely warmed up. Only a small load is being applied to the engine when grass is not being cut, this load being comprised of the rotating flywheel and the rotating blade. When the speed droop is set at 300 to 500 rpm, the air vane governor may misinterpret the light load comprised of the rotating blade and flywheel as constituting an applied load (grass cutting), and may begin to seek the appropriate governed speed. As a result, the engine appears to sputter or stumble.

If, on the other hand, the speed droop is set to 600 to 800 rpm, the sensitivity of the air vane governor during engine warmup is reduced. However, the increased speed droop also results in an undesirable loss of horsepower output when heavier loads are applied.

To avoid the above-described disadvantages of typical prior art air vane governors, engine manufacturers have often used electronic governors, or mechanical governors having centrifugally-responsive flyweights. Although electronic and centrifugal governors operate satisfactorily, they are significantly more expensive and have more components than air vane governors.

SUMMARY OF THE INVENTION

An improved air vane governor is disclosed which has a relatively small amount of governor speed droop when a load is applied, but in which the engine does not stumble during warmup or under no load or light load conditions.

The air vane governor according to the present invention includes a plurality of fins affixed to and rotatable with a support member such as a flywheel, a movable air vane having a surface that deflects air from the fins as the fins rotate with the support member, a primary resilient member interconnected between the engine housing and the air vane, and a secondary resilient member interconnected between the engine housing and the air vane. The primary resilient member applies a primary force in opposition to the movement of the air vane under no load conditions and whenever a load is applied to the engine. The secondary resilient member applies a secondary force in opposition to the movement of the air vane when the load applied to the engine is below a low load value. In other words, the secondary resilient member only applies a significant force at no load and low load conditions. In a preferring embodiment, the primary and secondary resilient members are each coil springs, although elastomeric members or other types of springs could be used.

The preferred embodiment of the present invention also includes a control bracket, interconnected between the secondary resilient member and the engine housing, which includes a means for adjusting the secondary force. The adjusting means many include either a movable tab to which the secondary resilient member is connected, or a plurality of apertures, one of which receives an end of the secondary resilient member. The primary force may be adjusted by a movable speed control lever connected between the primary resilient member and the engine housing.

A link member connects the air vane to the throttle lever for opening or closing the engine throttle. Both the primary resilient member and the secondary resilient member are also connected to the link member. The secondary resilient member has an end that makes a lost motion connection with the link member, such that the secondary resilient member only applies its secondary force to the air vane through the link member when the load applied to the engine is below the low load value.

The air vane governor according to the present invention operates in the following manner. Under no load or light load conditions, both the primary and the secondary resilient members apply a force in opposition to air vane movement. Due to the lost motion connection between the secondary resilient member and the link member, the secondary resilient member does not apply a spring force after about 1 to 1½ horsepower of the applied load. Thereafter, only the primary resilient member applies a force in opposition to the movement of the air vane. As a result, the air vane governor may be calibrated for about 300 to 500 rpm of speed droop without the governor being overly sensitive to minute changes in the apparent load under no load or light load conditions. Engine sputtering is thereby eliminated under no load and light load conditions.

Although the present invention actually increases the speed droop when a load is first applied to the engine, the engine runs more evenly under no load and light load conditions. However, the overall speed droop when the load is fully applied to the engine and when the engine is at wide open throttle (WOT) is equal to or less than the speed droop in typical prior art air vane governors.

It is a feature and advantage of the present invention to provide an air vane governor that enables the engine to run more evenly while the engine is warming up.

It is yet another feature and advantage of the present invention to provide an air vane governor that enables the engine to run more evenly when the engine is under no load or light load.

It is yet another feature and advantage of the present invention to provide an air vane governor that has decreased speed droop while still allowing the engine to run evenly.

These and other features of the present invention will be apparent to those skilled in the art from the following detailed description of the preferred embodiment and the drawings, in which:

DETAILED DESCRIPTION

Figure 1:
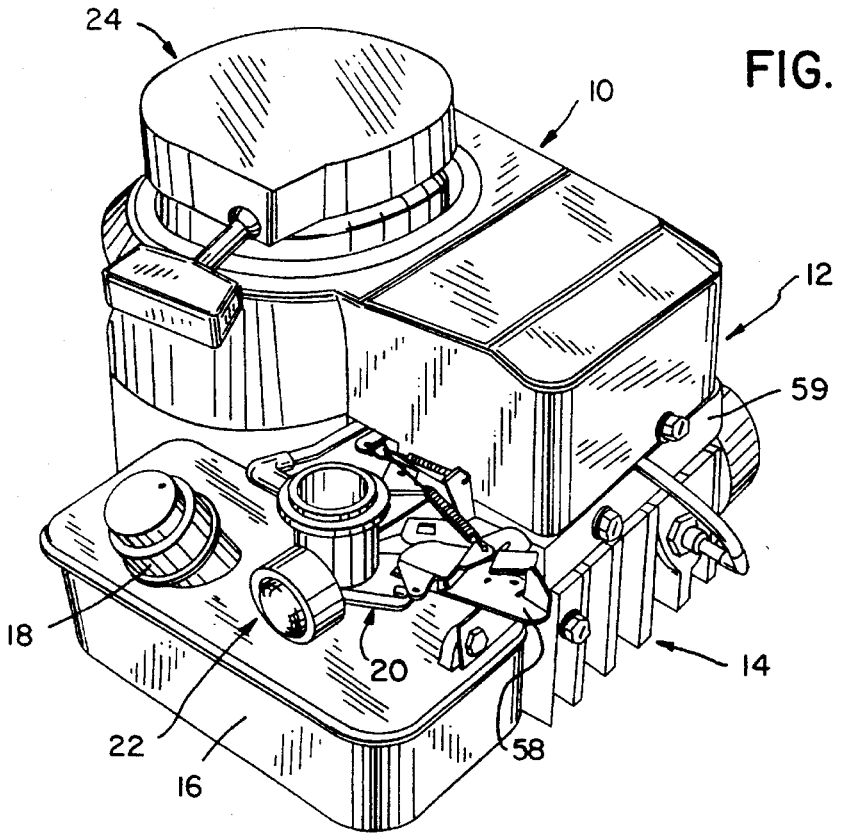
FIG. 1 is a perspective view of an internal combustion engine incorporating the air vane governor according to the present invention.
Figure 2:
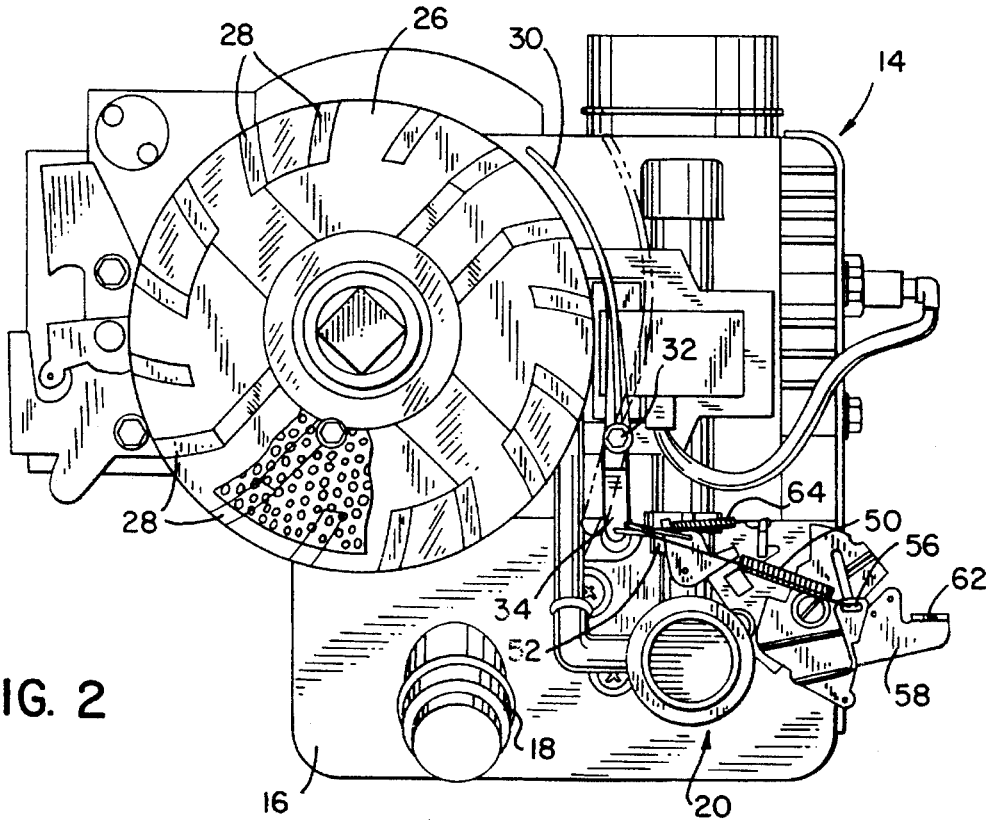
FIG. 2 is a plan view of the engine of FIG. 1, with the throttle in the wide open position.
Figure 3:
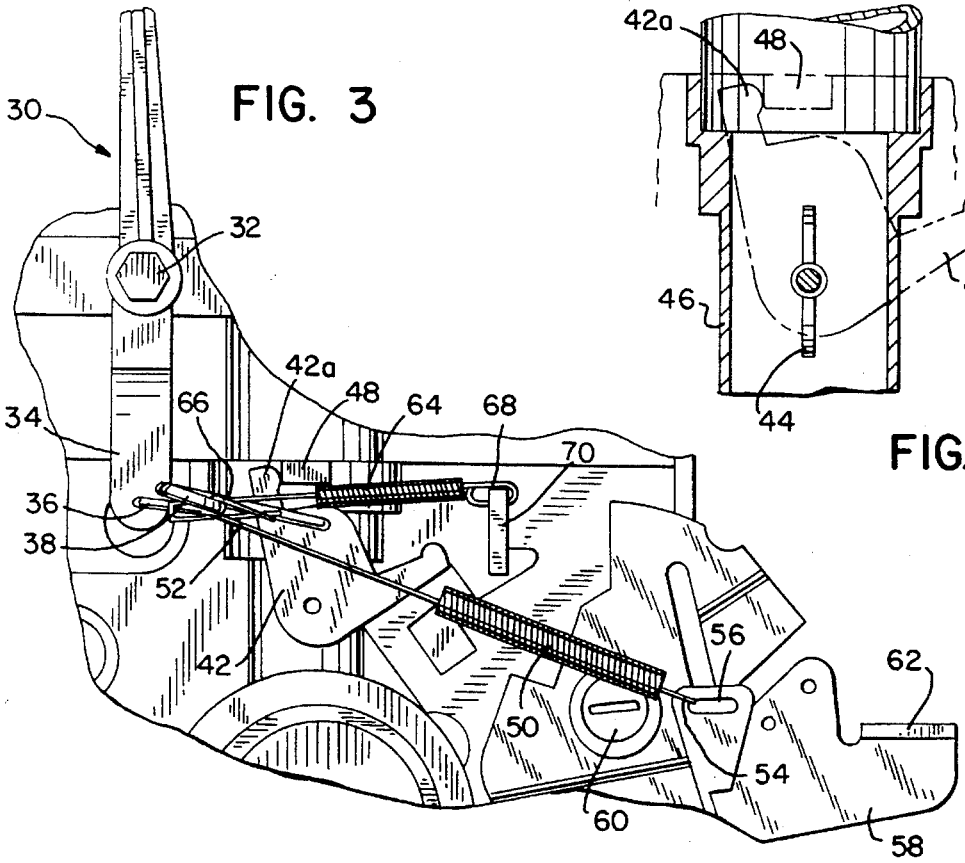
FIG. 3 is a plan view of the governor spring-link member assembly according to the present invention, when the throttle is in the wide open position.

FIGS. 1 and 2 depict an internal combustion engine incorporating the present invention. In FIG. 1 and 2, engine 10 includes a housing 12, an engine cylinder 14, a fuel tank 16 having a spout 18, a single barrel carburetor 20 having a primer mechanism 22, and a pull-type starter rewind assembly 24. Cylinder 14 includes a reciprocating piston (not shown), which in turn drives a rotatable crankshaft (not shown).

As best shown in FIG. 2, a rotatable flywheel 26 supports a plurality of fins 28. Although a flywheel is preferred as a support member, other types of support members may be used to support fins 28. Flywheel 26 is interconnected with the crankshaft (not shown) and rotates therewith.

When fins 28 are rotating, they generate an air flow that is deflected by an air vane 30. Air vane 30 pivots about a pivot point 32 in response to the air flow. The greater the rotational speed of flywheel 26 and fins 28, the greater the deflection of air vane 30, as shown in phantom in FIG. 2.

Figure 5:
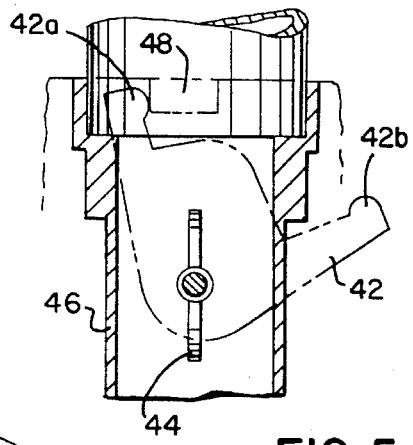
FIG. 5 is an exploded view of a carburetor throat depicting the throttle and the throttle lever in the wide open position.
Figure 8:
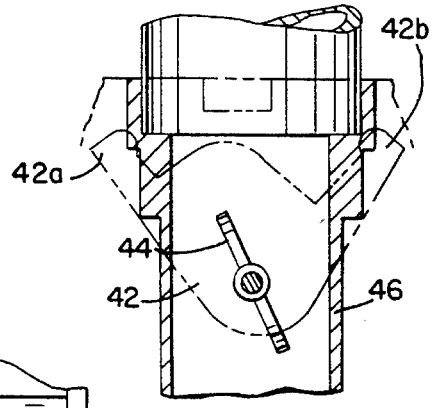
FIG. 8 is an exploded view of the carburetor throat when the throttle and the throttle lever are in the light load position.

As best shown in FIGS. 2, 3, 6 and 9, air vane 30 includes an opposite end 34 to which is connected an end 36 of a link member 38. An opposite end 40 of link member 38 is connected to a throttle control lever 42. As best shown in FIGS. 5, 8 and 10, throttle control lever 42 is interconnected with a throttle valve 44.

Throttle valve 44 is opened or closed in response to the movement of throttle control lever 42. The position of throttle 44 controls the amount of intake air that passes through carburetor throat 46, which in turn controls the amount of fuel that enters the carburetor throat, in response to the venturi effect. When the throttle is in the wide open throttle (WOT) position as depicted in FIG. 5, a maximum amount of fuel enters carburetor throat 46 and is available for combustion, so that the engine generates maximum power. When the throttle is in the WOT position as depicted in FIG. 5, the engine generates sufficient power to handle the maximum load that may be applied to the engine. When throttle 44 is nearly closed as depicted in FIG. 10, either no load or a very light load is applied to the engine; in this position, the engine does not generate enough power to drive higher loads. In FIG. 5, throttle control lever 42 has reached one end of its rotational travel since arm **42*a* of lever 42 abuts stop 48. As shown in FIG. 10, throttle control lever 42 has reached its opposite end of rotational travel, since arm 42*b* of lever 42 abuts stop 48**.

FIG. 8 depicts throttle control lever 42 and throttle 44 in an intermediate position, where the throttle is partially open.

As best shown in FIGS. 2, 3, 6 and 9, a primary resilient member 50 has an end 52 that is interconnected with link member 38. More specifically, end 52 is retained in a loop of the link member. End 52 is bent in a paperclip manner to prevent end 52 from detaching from link member 38. See FIG. 7. An opposite end 54 of primary resilient member/primary spring 50 is disposed in an aperture 56 of a pivotable speed control lever 58. Speed control lever 58 pivots about a pivot 60 which in turn is affixed to speed control bracket 59. Bracket 59 is connected to the engine housing. The operator may adjust the tension on spring 50 by moving a tab 62 on speed control lever 58. Adjusting the tension of spring 50 changes the force applied by spring 50 onto link member 38, in opposition to the movement of air vane 30. Spring 50 applies a force in opposition to the air vane movement throughout the entire range of air vane movement, and thus throughout the entire range of engine loads.

The present invention also includes a secondary resilient member or secondary spring 64, as best shown in FIGS. 2, 3, 6 and 9. Secondary spring 64 has a first end 66 interconnected with link member 38, and a second end 68 interconnected with an adjustable tab 70. Tab 70 is part of speed control bracket 59. First end 66 and second end 68 are bent in a paperclip manner to prevent first end from detaching from link member 38, and to prevent second end 68 from detaching from tab 70. Tension applied to secondary spring 64 may be adjusted by moving and repositioning tab 70. In the alternative, tab 70 may include a plurality of apertures, with second end 68 being disposed in one of the apertures. Secondary spring 64 applies a secondary force to link member 38 in opposition to the movement of air vane 30 only when no load or light loads are applied to the engine. Springs 50 and 64 are preferably coil springs, although elastomeric members or other types of springs may be used.

Figure 4:
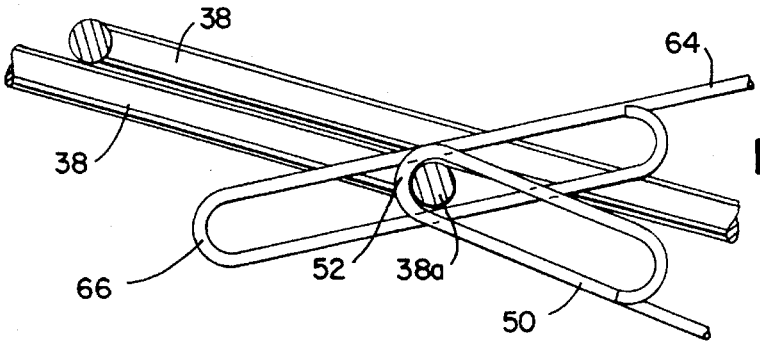
FIG. 4 is an exploded view of the spring-link member assembly depicting the lost motion position of the secondary spring under high load and wide open throttle conditions.

FIGS. 2 through 5 depict the governor when the throttle is in the wide open throttle (WOT) position. The engine is typically in the wide open throttle position when maximum power is required to drive a heavy load. In the governor according to the present invention, only primary spring 50 applies a force that opposes the movement of the air vane when the throttle is in the WOT position. In other words, secondary spring 64 is not operational at the WOT position. Secondary spring 64 is rendered inoperative when the applied engine load exceeds a low load value due to the lost motion-type of connection between secondary spring 64 and link member 38. This lost motion connection is depicted in FIG. 4.

In FIG. 4, the loop in link member 38 has been removed for purposes of clarity. As shown in FIG. 4, end 66 of secondary spring 64 does not abut section 38*a* of link member 38, so that spring 64 does not apply a substantial force to link member 38. As a result, the spring force and tension of secondary spring 64 are not transmitted to air vane 30 under high load conditions. On the other hand, end 52 of primary spring 50 does indeed positively abut section 38*a* of link member 38, so that the spring force and tension of primary spring 50 are applied to the link member, which in turn applies a force to air vane 30 to oppose the movement of the air vane.

Figure 6:
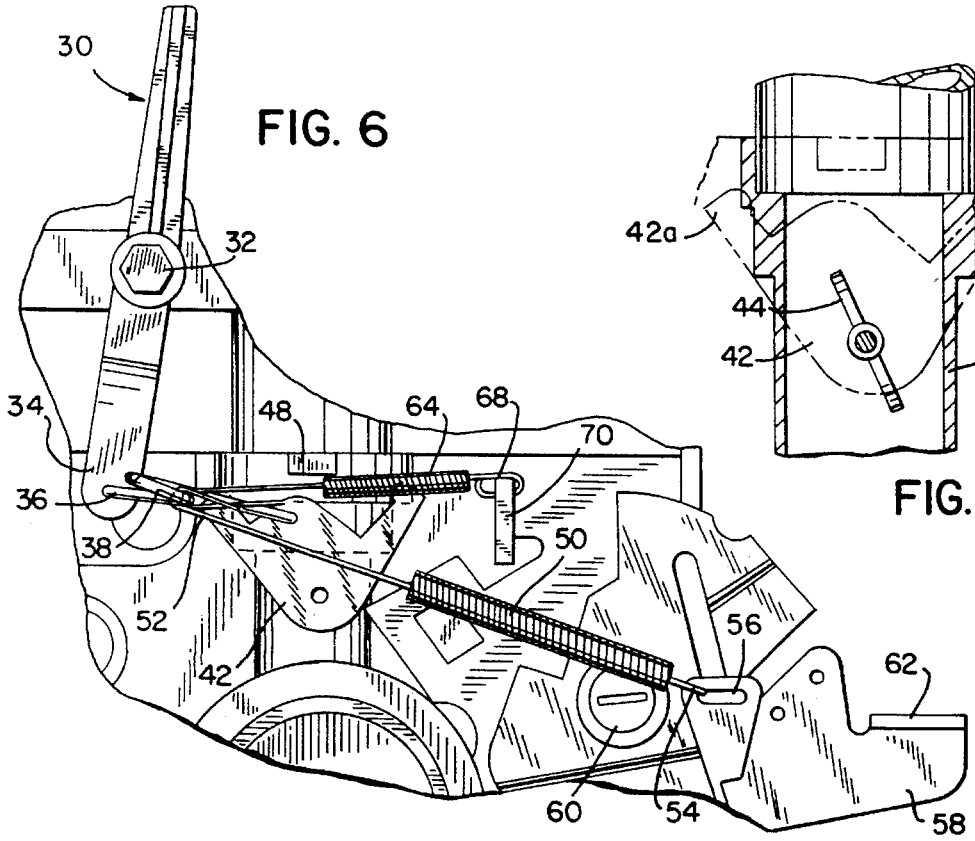
FIG. 6 is a plan view of the spring assembly depicting the throttle in the light load position.
Figure 7:
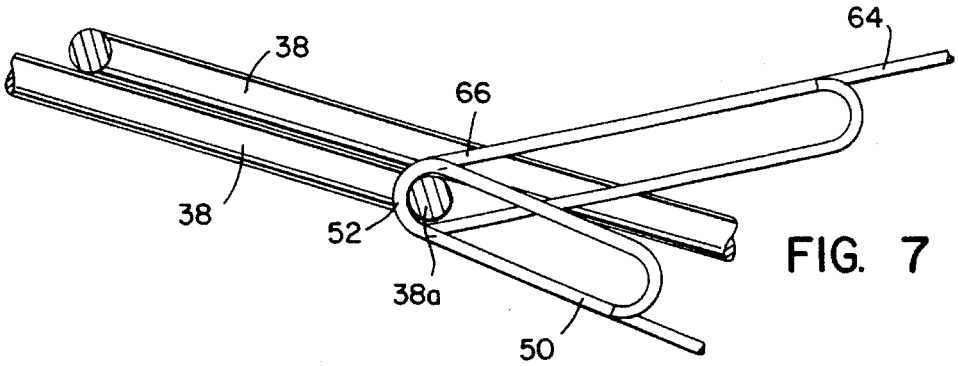
FIG. 7 is an exploded view of the spring-link member assembly when the engine is under a no load or light load condition.

FIGS. 6 through 8 depict the governor assembly and the throttle when a light load, just below the cut off low load value is being applied to the engine. Under conditions of such light load, throttle control lever 42 is disposed between its two ends of travel, as best shown in FIG. 8. Throttle 44 is partially closed. As best shown in FIG. 7, spring end 52 of primary spring 50, and spring end 66 of secondary spring 64, both positively abut link member section 38*a* of link member 38, and apply respective forces to the link member. As a result, the spring forces of springs 50 and 64 oppose the movement of air vane 30 whenever the load applied to the engine is below the low load value. The low load value preferably corresponds to 1 to 1½ horsepower of engine output power, although other values may be used.

Figure 9:
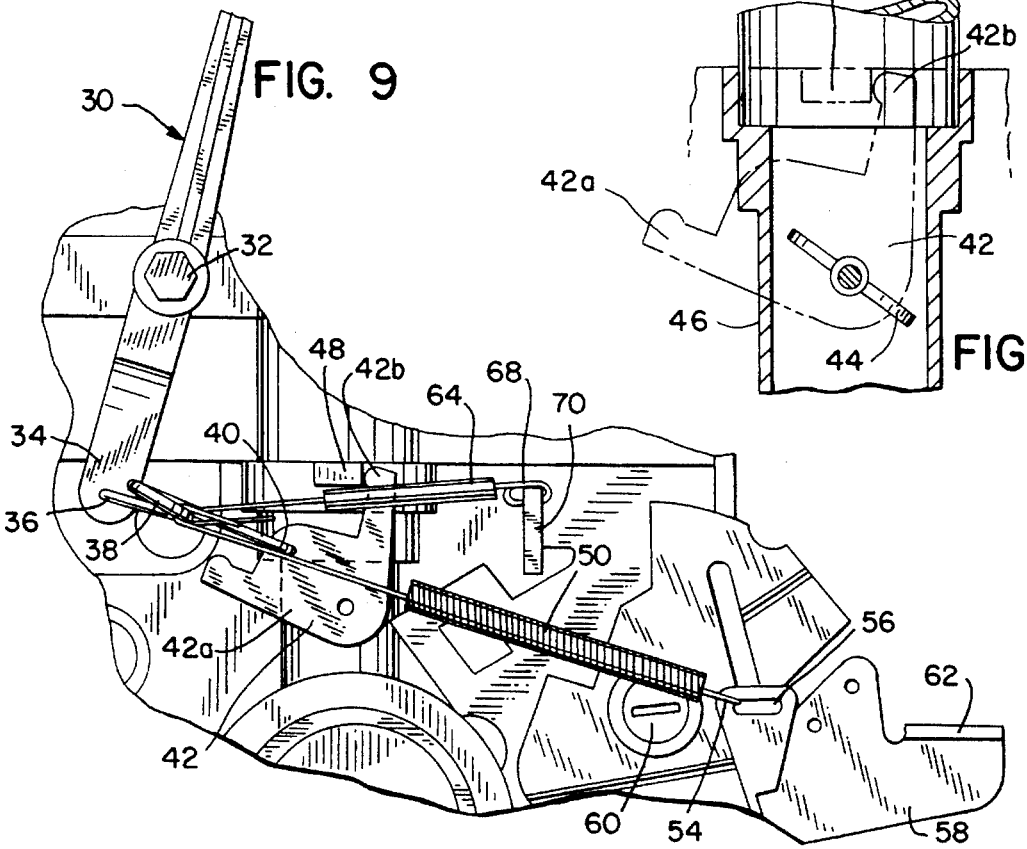
FIG. 9 is an exploded view of the spring-link member assembly when the engine is under no load.
Figure 10:
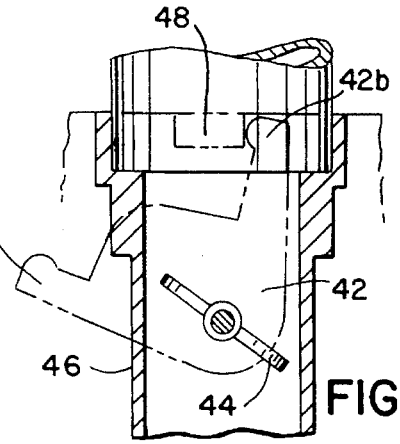
FIG. 10 is an exploded view of a carburetor throat with the throttle and the throttle lever in the no load position.

FIGS. 9 and 10 depict the governor assembly and the carburetor throat when no load is being applied to the engine. In FIGS. 9 and 10, throttle control lever 42 has reached its no load stop, since arm 42*b* abuts stop 48. In this position, the spring forces of both primary spring 50 and secondary spring 64 oppose the movement of air vane 30. Thus, the interplay between the forces applied by springs 50 and 64 and the force applied by the air flow on air vane 30 determine the engine governed speed by determining the position of throttle 44.

The use of two springs under no load and light load conditions according to the present invention has significant advantages when compared to prior art air vane governors that use only a single governor spring. In prior art air vane governors, relatively small changes in the rotational speed of the crankshaft during engine warm up cause significant changes in the air flow generated by fins 28 (FIG. 2), and thereby cause air vane 30 to change position. As a result, the throttle would tend to be somewhat opened or somewhat closed in response to relatively small changes in crankshaft rotational speed, causing the engine to sputter during warm up at no load and light load conditions.

In the present invention, the application of the secondary spring force under no load and light load conditions provides a greater force to oppose the movement of the air vane in response to small changes in crankshaft rotational speed, thereby effectively reducing the sensitivity of the governor under no load and light load conditions. Since the governor's sensitivity has been reduced, the overall speed droop may also be reduced when compared to prior art, single spring air vane governors.

Figure 11:
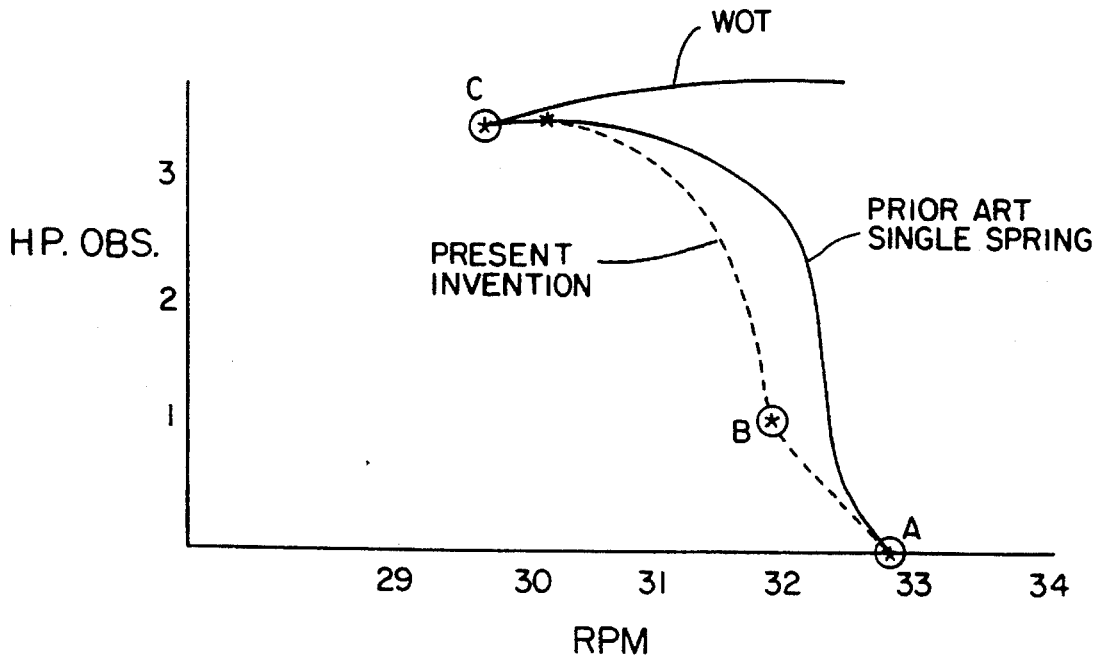
FIG. 11 is a graph depicting speed droop curves for a prior art air vane governor and an air vane governor according to the present invention.

The effect of the present invention on governor droop characteristics is best understood in connection with FIG. 11. FIG. 11 depicts three curves of governor droop characteristics: a prior art curve when a single spring is used; the curve of the present invention, shown in a dotted line; and the curve when a load is applied and the engine is initially in the WOT position.

As shown in FIG. 11, both the prior art single spring curve and the curve according to the present invention begin at a point A. Point A corresponds to 3300 rpm, with no load applied to the engine. When a load is applied to the engine, the horsepower observed increases as the engine speed decreases or droops. In the prior art air vane governor curve, the speed drops approximately 100 rpm until the observed horsepower reaches approximately 2½ horsepower, at which time the speed drops very rapidly.

In the present invention, the speed drops over 100 rpm while both the primary and secondary spring forces are applied, corresponding to the portion of the curve between point A and point B. Point B corresponds to approximately 1 to 1½ horsepower of applied load, and is the point at which the secondary spring drops out. The engine speed then slowly drops continuously until point C is reached.

As shown by the wide open throttle curve, the speed droops almost linearly when the load is applied if the throttle is initially at the WOT position.

However, all of the curves intersect at point C, which corresponds to approximately 2950 rpm.

While the preferred embodiment of the present invention is shown and described, alternate embodiments will be apparent to those skilled in the art and are within the intended scope of the present invention. Therefore, the invention is to be limited only by the following claims.

I claim:

1. An improved air vane governor for an internal combustion engine, said engine having a housing, said governor comprising:

a plurality of fins affixed to and movable with a support member;

a movable air vane having a surface that deflects air from said fins as said fins move with said support member;

a primary resilient member, interconnected between said engine housing and said air vane, that applies a primary force in opposition to the movement of said air vane when a load is applied to said engine; and a secondary resilient member, interconnected between said engine housing and said air vane, that applies a secondary force in opposition to the movement of said air vane when the load applied to said engine is below a low load value.

2. The air vane governor of claim 1, further comprising:

a control bracket interconnected between said secondary resilient member and said housing.

3. The air vane governor of claim 2, wherein said control bracket includes:

means for adjusting said secondary force.

4. The air vane governor of claim 3, wherein said adjusting means includes:

a movable tab to which said secondary resilient member is connected.

5. The air vane governor of claim 3, wherein said adjusting means includes:

a plurality of apertures in said control bracket, said secondary resilient member having an end disposed in one of said apertures.

6. The air vane governor of claim 1, further comprising:

a movable speed control lever interconnected between said primary resilient member and said engine housing.

7. The air vane governor of claim 6, further comprising:

a control bracket interconnected between said secondary resilient member and said housing, and interconnected between said speed control lever and said housing.

8. The air vane governor of claim 1, wherein said primary and secondary resilient members are coil springs.

9. The air vane governor of claim 1, wherein said low load value corresponds to between 1 to 1½ horsepower output of said engine.

10. The air vane governor of claim 1, further comprising:

a link member connected between said second resilient member and said air vane.

11. The air vane governor of claim 10, wherein said second resilient member has an end that makes a lost motion connection with said link member.

12. The apparatus of claim 10, wherein said primary and secondary members are coil springs.

13. The apparatus of claim 10, wherein said low load value corresponds to between 1 to 1½ horsepower output of said engine.

14. Apparatus that changes the droop characteristics of an air vane governor of an engine, said engine having a housing, said governor having an air vane that is movable in response to the movement of a plurality of fins, comprising:

a primary resilient member, interconnected between said engine housing and said air vane, that applies a primary force in opposition to the movement of said air vane when a load is applied to said engine; and a secondary resilient member, interconnected between said engine housing and said air vane, that applies a secondary force in opposition to the movement of said air vane when the load applied to said engine is below a low load value.

15. The apparatus of claim 14, further comprising:

a control bracket interconnected between said second resilient member and said housing.

16. The apparatus of claim 14, wherein said control bracket includes:

means for adjusting said secondary force.

17. The apparatus of claim 16, wherein said adjusting means includes:

a movable tab to which said secondary resilient member is connected.

18. The apparatus of claim 16, wherein said adjusting means includes:

a plurality of apertures in said control bracket, said second resilient member having an end disposed in one of said apertures.

19. The apparatus of claim 14, further comprising:

a movable speed control lever interconnected between said primary resilient member and said engine housing.

20. The apparatus of claim 19, further comprising:

a control bracket interconnected between said secondary resilient member and said housing, and interconnected between said speed control lever and said housing.

21. The air vane governor of claim 14, further comprising:

a link member connected between said second resilient member and said air vane.

22. The air vane governor of claim 21, wherein said second resilient member has an end that makes a lost motion connection with said link member.

* * * * *